US012612715B2

(12) United States Patent
Shang et al.

(10) Patent No.: US 12,612,715 B2
(45) Date of Patent: Apr. 28, 2026

(54) HIGH-EFFICIENCY FLAME-RETARDANT, LIGHT, THIN AND SOFT MULTI-FIBER BLENDED FABRIC AND PREPARATION METHOD THEREOF

(71) Applicant: Xinxiang Xinke Protective Technology Co ., Ltd, Xinxiang (CN)

(72) Inventors: Jun Shang, Xinxiang (CN); Keqin Wang, Xinxiang (CN); Xuejian Guo, Xinxiang (CN); Songtao Guo, Xinxiang (CN)

(73) Assignee: Xinxiang Xinke Protective Technology Co ., Ltd, Xinxiang (CN)

( * ) Notice: Subject to any disclaimer, the term of this patent is extended or adjusted under 35 U.S.C. 154(b) by 818 days.

(21) Appl. No.: 17/902,502

(22) Filed: Sep. 2, 2022

(65) Prior Publication Data

US 2023/0257917 A1 Aug. 17, 2023

(30) Foreign Application Priority Data

Jul. 1, 2022 (CN) ..... 202210773912.7

(51) Int. Cl.
*D03D 15/283* (2021.01)
*D01F 1/07* (2006.01)
(Continued)

(52) U.S. Cl.
CPC ..... *D02G 3/045* (2013.01); *D01F 1/07* (2013.01); *D01F 1/09* (2013.01); *D02G 3/443* (2013.01);
(Continued)

(58) Field of Classification Search
CPC .. D06M 15/03; D06M 11/82; D06M 2200/30; D02G 3/443; D01F 1/07; D03D 15/513; C09K 21/00–14
See application file for complete search history.

(56) References Cited

U.S. PATENT DOCUMENTS 7,018,567 B2 3/2006 Murray
9,765,453 B2 9/2017 Deng et al.
(Continued)

FOREIGN PATENT DOCUMENTS

CN 1693421 A 11/2005
CN 102656303 A 9/2012
(Continued)

OTHER PUBLICATIONS

"CN105369592_Machine Translation" is a machine translation of CN-105369592-A. (Year: 2016).*

*Primary Examiner* — Larissa Rowe Emrich
(74) *Attorney, Agent, or Firm* — Anova Law Group, PLLC

(57) ABSTRACT

The present invention discloses a highly effective flame-retardant lightweight and soft multi-fiber blended fabric and a preparation method thereof. The fabric comprises 82 to 87 wt % of base fabric, 5 to 8 wt % of flame retardant and 8 to 10 wt % of antistatic agent. The base fabric comprises 45 to 48 wt % of polyacrylonitrile fibers, 40 to 42 wt % of cellulose fibers, 6 to 9 wt % of polyacrylate fibers and 6 to 8 wt % of polyamide fibers in parts by mass. The material has the characteristics of highly effective flame retardance, lightweightness and softness, with the gram weight being 215 g/m. A test shows that the material can come up to the NFPA2112 standard, and the arc-proof ATPV is greater than 8 cal/cm$^2$.

9 Claims, 2 Drawing Sheets

(51) Int. Cl.

| | |
|---|---|
| ***D01F 1/09*** | (2006.01) |
| ***D02G 3/04*** | (2006.01) |
| ***D02G 3/44*** | (2006.01) |
| ***D03D 15/513*** | (2021.01) |
| ***D03D 15/533*** | (2021.01) |
| ***D06M 11/82*** | (2006.01) |
| ***D06M 15/03*** | (2006.01) |

(52) U.S. Cl.
CPC ..... *D03D 15/283* (2021.01); *D03D 15/513* (2021.01); *D03D 15/533* (2021.01); *D06M 11/82* (2013.01); *D06M 15/03* (2013.01); *D06M 2200/30* (2013.01); *D10B 2201/20* (2013.01); *D10B 2321/08* (2013.01); *D10B 2321/10* (2013.01); *D10B 2331/02* (2013.01); *D10B 2501/04* (2013.01)

(56) References Cited

U.S. PATENT DOCUMENTS

| | | | | |
|---|---|---|---|---|
| 10,253,437 | B2 | 4/2019 | Zhu | |
| 2006/0214142 | A1* | 9/2006 | Nikkeshi | C09K 21/06 252/601 |
| 2006/0292953 | A1* | 12/2006 | Ashley | A41D 31/08 442/310 |
| 2013/0212790 | A1 | 8/2013 | Waxman et al. | |
| 2013/0247287 | A1* | 9/2013 | Mizobuchi | D01F 6/40 428/221 |
| 2015/0159304 | A1* | 6/2015 | Schmitt | D02G 3/443 428/221 |
| 2019/0225737 | A1 | 7/2019 | Behabtu et al. | |
| 2021/0171737 | A1 | 6/2021 | Yoon et al. | |
| 2022/0010467 | A1 | 1/2022 | Tanaka et al. | |

FOREIGN PATENT DOCUMENTS

| | | | | |
|---|---|---|---|---|
| CN | 103881138 | A | 6/2014 | |
| CN | 105369592 | A * | 3/2016 | |
| CN | 108457090 | A | 8/2018 | |
| CN | 108951127 | A | 12/2018 | |
| CN | 109642347 | A | 4/2019 | |
| CN | 110341263 | A | 10/2019 | |
| CN | 110483663 | A | 11/2019 | |
| WO | WO-9100327 | A1 * | 1/1991 | C09K 21/10 |

* cited by examiner

HIGH-EFFICIENCY FLAME-RETARDANT, LIGHT, THIN AND SOFT MULTI-FIBER BLENDED FABRIC AND PREPARATION METHOD THEREOF

CROSS-REFERENCES TO RELATED APPLICATIONS

This application claims priority to Chinese Patent Application No. 202210773912.7, filed on Jul. 1, 2022, the content of all of which is incorporated herein by reference.

TECHNICAL FIELD

The present invention belongs to the field of special textile materials, and particularly relates to a highly effective flame-retardant lightweight and soft multi-fiber blended fabric and a preparation method thereof.

BACKGROUND

Special flame-retardant textile fabrics are common light industrial products in daily life. In the past, due to the low living standard, special textile fabrics were only required to meet basic flame-retardant requirements. Nowadays, with the improvement of the living standard, and the requirements of people on the functionality of special flame-retardant textile fabrics tend to be diversified and become higher and higher, e.g., higher requirements on lightweightness, softness, etc.

SUMMARY

In order to overcome the defects in a prior art, the present invention provides a highly effective flame-retardant lightweight and soft multi-fiber blended fabric and a preparation method thereof. The specific technical solution is as follows:

A highly effective flame-retardant lightweight and soft multi-fiber blended fabric comprises 82 to 87 wt % of base fabric, 5 to 8 wt % of flame retardant and 8 to 10 wt % of antistatic agent.

Further, the base fabric comprises 45% to 48% of polyacrylonitrile fibers, 40% to 42% of cellulose fibers, 6% to 9% of polyacrylate fibers and 6% to 8% of polyamide fibers in parts by mass.

The flame retardant comprises 70 to 80 wt % of hydroxylated polysaccharide, 15 to 25 wt % of boric acid compound and 5 wt % of guanidine sulfamate.

The antistatic agent is a metal alkoxide, which is one or more of aluminium isopropoxide, zinc diethoxide, or magnesium ethoxide.

Further, the ATPV (arc thermal performance value) of the blended fabric is greater than 8 cal/cm$^2$.

A preparation method for the highly effective flame-retardant lightweight and soft multi-fiber blended fabric includes the following steps:

(Step 1) a base fabric is washed; specifically, the base fabric is soaked in 10% of aqueous ethanol solution in parts by volume, heated under the condition of a water bath at 60° C. for 4 hours, washed with deionized water, and then dried in a drier at 60° C.;

(Step 2) after soaked in a grafting solution for 1 to 2 hours, the base fabric obtained in Step 1 is irradiated under ultraviolet light for 10 to 20 minutes, then washed with acetone and deionized water, and dried in the drier at 60° C.;

(Step 3) the first fabric obtained in Step 2 is soaked in a flame retardant solution according to a mass ratio of the flame retardant solution to the first fabric which is 10:1, shaken in a water bath shaker at a set temperature of 80° C. for 4 to 6 hours to ensure that the flame retardant sufficiently reacts with the blended fabric, and then washed with deionized water and dried;

(Step 4) the second fabric obtained in Step 3 is dipped and rolled twice in metal alkoxide sol, pre-baked, and then baked to give the final product, with the padding pressure being 1 kg/cm$^3$, the pre-baking temperature being 100° C. and the duration of pre-baking being 3 to 6 minutes.

Further, the grafting solution in Step 2 is 5% to 10% of solution of glycidyl methacrylate in methanol in parts by volume; and the grafting rate is controlled below 45% in order to avoid the influence of an excessive grafting rate on the lightweight and soft properties of the blended fabric. The grafting rate is calculated according to the following formula $$GP = \frac{W_1 - W_0}{W_0} \times 100\%,$$

where $W_0$ is the fabric mass before grafting, and $W_1$ is the fabric mass after grafting.

The flame retardant solution in Step 3 is prepared by dispersing and dissolving a flame retardant including 70% to 80% of hydroxylated polysaccharide, 15% to 25% of boric acid compound and 5% of guanidine sulfamate into 2% of acetic acid solution in parts by volume, with the flame retardant being 5% to 8% in parts by mass. The hydroxylated polysaccharide is chitosan, sodium alginate, cyclodextrin or a mixture thereof; and the boric acid compound is boric acid, ammonium borate or a mixture thereof.

Preferably, the hydroxylated polysaccharide with a grain size of 50 nm to 100 nm is derived from a plant, and can be completely dissolved in water or acetic acid.

Further, the flame retardant is added into a colorless and transparent acetic acid solution under the condition of stirring at a stirring rate of 30 r/min to give a dispersed flame retardant solution, and the solution can be heated to 40° C. for homogeneous dissolution.

In Step 4, the metal alkoxide sol is prepared by the following method: metal alkoxide is added into a closed container filled with deionized water at 85° C. to form a white precipitate; while the temperature of 85° C. is kept, the closed container is opened, so that alcohol is volatilized, hydrochloric acid accounting for 20% of the mass of the metal alkoxide is added, so that the precipitate is re-separated, and after 3 to 5 hours of aging, the metal alkoxide sol is obtained. The specific technological parameters of dipping and rolling twice are as follows: dipping and rolling are carried out twice at room temperature, with the padding pressure being 1 kg/cm$^3$; the pre-baking temperature is 100° C., and the duration is 3 to 6 minutes; the baking temperature is 120° C., and the duration of baking is 3 minutes.

Preferably, the preparation method further includes Step 5: the product prepared in Step 4 is softened with the air, that is, air flow generated by a centrifugal fan, the direction of which is changed alternately, acts on the resulting fabric, so as to further increase the softness of the fabric.

According to the present invention, since the fabric materials include the hydroxylated polysaccharide, the metal alkoxide solution, the multi-fiber blended base fabric, etc. in conjunction with the special preparation method, the blended fabric is prepared by the grafting of the hydroxylated polysaccharide as a main flame retardant component, the formation of the organic-inorganic hybrid flame-retardant system by a sol-gel technique, the introduction of the antistatic agent and padding. Since the components of the base fabric of the flame-retardant fabric according to the present invention are 45 to 48 wt % of polyacrylonitrile fibers, 40 to 42 wt % of cellulose fibers, 6 to 9 wt % of polyacrylate fibers and 6 to 8 wt % of polyamide fibers, when the blended fabric is burning, the hydroxylated polysaccharide introduced into the polyacrylonitrile fibers and the cellulose fibers is carbonized under high temperature into a dense isolating layer, and at the same time, the construction of the inorganic flame-retardant system on the polyacrylate fibers and the polyamide fibers can also achieve condensed-phase and gas-phase flame retardance, thus achieving a highly effective flame-retardant effect of the fabric. Moreover, since the metal alkoxide solution endows the blended fabric with antistatic capability, when subjected to the action of an arc, the blended fabric can diffuse current in time to prevent extreme heat release by the arc. Since the hydroxylated polysaccharide is biodegradable, green, renewable and abundant in natural reserves, the problem that residues containing phosphorus-based flame retardants in the prior art pose an impact on the environment is solved. A test shows that the fabric prepared by the present invention comes up to the NFPA2112 standard, the ATPV is greater than 8 cal/cm$^2$, and the gram weight is 215 g/m$^2$.

The beneficial technical effects of the present invention are as follows: since the present invention adopts the sol-gel technique to construct the organic-inorganic hybrid flame-retardant system, not only is the lightweightness and softness of the fabric not affected, but also when the fabric is burnt at high temperature, the produced dense carbon layer and hard-to-pyrolyze boron oxide can effectively cover the surface of the fabric, the flame-retardant fibers are further pyrolyzed, nitrogen-containing compounds can produce $N_2$, NO, $NO_2$ and other non-flammable gas phases to dilute the concentration of oxygen in the burning area, and therefore the synergistic action of condensed-phase flame retardance and gas-phase retardance is achieved, making flame-retardant capability come up to the NFPA2112 standard; moreover, since the hydroxylated polysaccharide as a main substance in the flame retardant system is derived from a plant, the hydroxylated polysaccharide is green, renewable and rich in natural reserves; the preparation method is simple, and the fabric is highly skin-compatible. In the prior art, flame-retardant and arc-proof fabrics are heavy, because a thick layer of coating is applied on the outside. The organic-inorganic hybrid flame-retardant system constructed by the present invention can achieve the object of improving flame-retardant property in a small amount, and moreover, the lightweight and soft properties of the fabric itself will not be affected by the adoption of the sol-gel method. That is, the present invention can keep the comfort of the fabric and endow the fabric with functionality.

In addition, because the fabric according to the present invention has electrical conductivity through cross-linked metal oxide, an electromagnetic protective layer can be formed under the action of an arc to diffuse current in time, preventing extreme heat release by the arc, the ATPV is greater than 8 cal/cm$^2$, and thereof the fabric can be applied to the field of arc resistance. The fabric is applicable in the production of textiles, such as textile clothing, decorative articles and military fabrics for national defense, and other fabric products.

DESCRIPTION OF EMBODIMENTS

Figure 1:
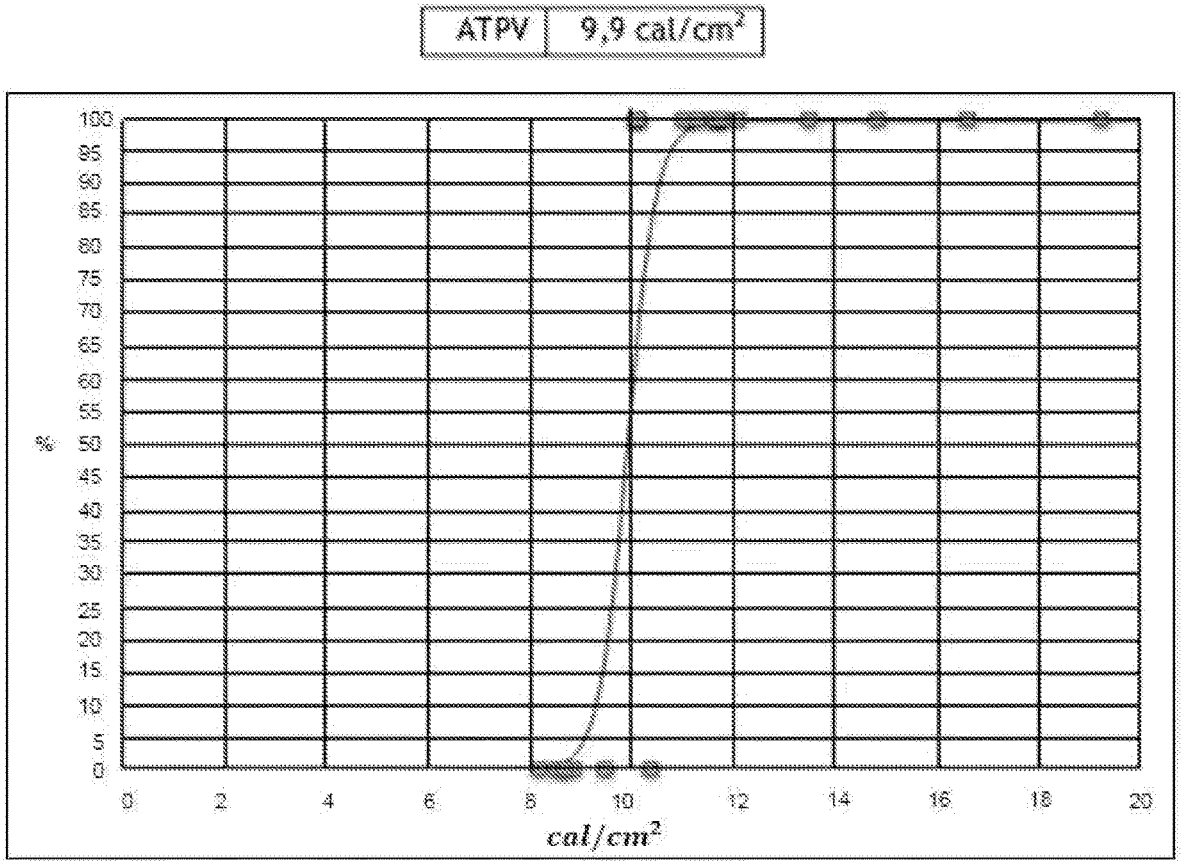
FIG. 1 is an ATPV test result of a product prepared in Example 1 according to the present invention.

The technical solution in the embodiment of the present invention will be clearly and fully described below with reference to the drawings in the embodiment of the present invention. Apparently, the described embodiment is only part of the embodiments of the present invention, rather than all the embodiments. On the basis of the embodiments in the present invention, all other embodiments which those skilled in the art obtain without making creative efforts shall fall within the protection scope of the present invention.

Example 1

(1) Preparation of Materials and Washing of Base Fabric

Chitosan, ammonium borate and guanidine sulfamate were weighed according to a mass ratio of 80:15:5 for later use.

2% of colorless and transparent acetic acid solution in parts by volume was prepared for later use.

A base fabric including 45 wt % of polyacrylonitrile fibers, 40 wt % of cellulose fibers, 8 wt % of polyacrylate fibers and 7 wt % of polyamide fibers was soaked in 10% of aqueous ethanol solution in parts by volume, and was heated under the condition of a water bath at 60° C. in order to remove impurities carried by the yarns themselves and impurities covering the fabric surface during weaving. 4 hours later, the base fabric was taken out, washed with deionized water multiple times, and dried in a drier at 60° C.

(2) Grafting

After the dried base fabric was soaked in a grafting solution for 2 hours, the fabric was taken out to be irradiated by ultraviolet light for 10 minutes, then washed twice with acetone and deionized water respectively, and dried in the drier at 60° C. The grafting solution was glycidyl methacrylate dissolved in methanol, the concentration of which was 5% to 10% in parts by volume and the grafting rate of which was controlled at 40%.

(3) Preparation of Flame-Retardant Blended Fabric

Chitosan, ammonium borate and guanidine sulfamate, the total mass of which was 8 wt %, were added into the colorless and transparent acetic acid solution under the condition of stirring at a stirring rate of 30 r/min to give a dispersed flame retardant solution, and the solution could be heated to 40° C. for homogeneous dissolution.

The washed fabric was immersed into the dispersed flame retardant solution according to a bath ratio of 10:1, and was shaken in a water bath shaker with the temperature set and kept at 80° C. for 6 hours to ensure the sufficient reaction between the flame retardant and the fabric, and the fabric was then washed with deionized water three times and dried.

(4) Preparation of Arc-Proof and Flame-Retardant Blended Fabric

A closed container filled with deionized water was heated to 85° C., and this temperature was kept;

one part by mass of aluminium isopropoxide was dissolved into two parts by mass of isopropyl alcohol to prepare an isopropyl alcohol solution, and the isopropyl alcohol solution was slowly added into deionized water at 85° C. under the condition of stirring, with the added amount being 3% (V/V) by volume and the duration of addition being 15 minutes, so that a white precipitate was formed ultimately; while the high temperature continued to be kept, the closed container was opened, so that alcohol was volatilized, hydrochloric acid accounting for 20% of aluminium isopropoxide in parts by mass was added, so that the precipitate was re-separated, and after 5 hours of aging, transparent sol gel was obtained;

the flame-retardant fabric was dipped and rolled twice in the prepared transparent aluminium isopropoxide sol gel, pre-baked, and then baked, with the padding pressure being 1 kg/cm$^3$, the pre-baking temperature being 100° C., the duration of pre-baking being 6 minutes, the baking temperature being 140° C. and the duration of baking being 3 minutes, so that the final product was ultimately obtained, the gram weight of which was 215 g/m$^2$.

(5) Testing

Figure 2:
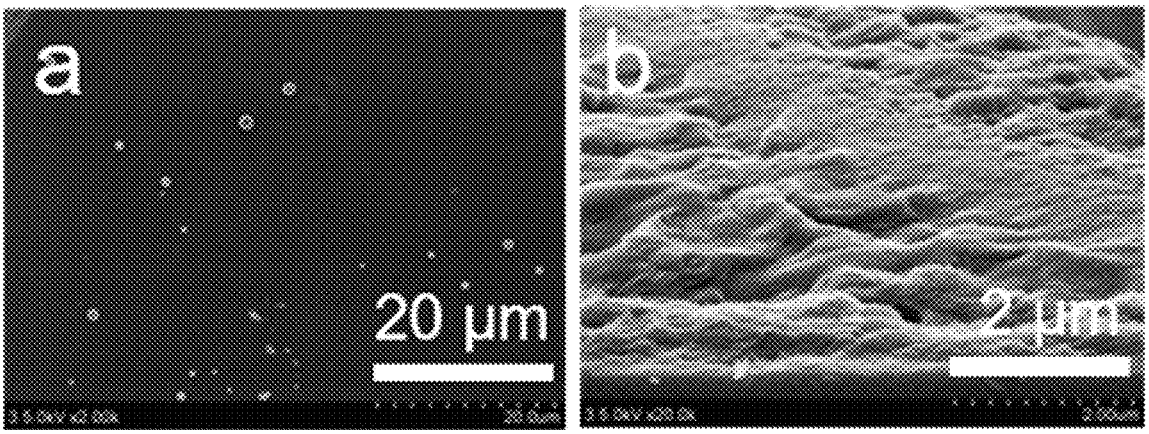
FIG. 2 is SEM images of a dense protective layer formed on the surface of the product prepared in Example 1 according to the present invention after burning.
Figure 3:
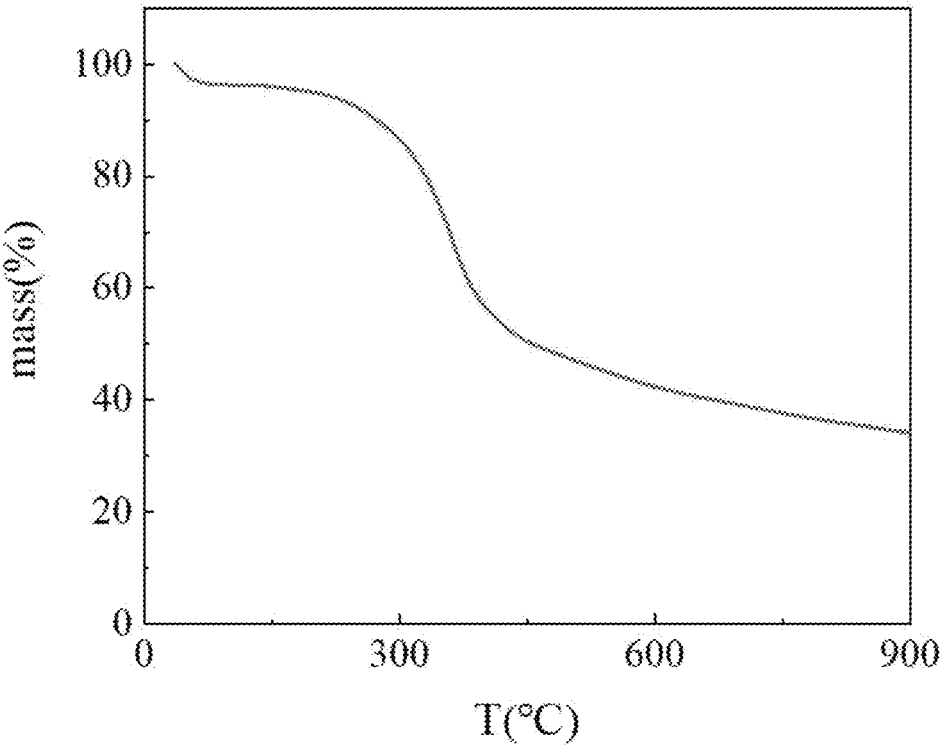
FIG. 3 is a thermal stability test result of the product prepared in Example 1 according to the present invention.

The test methods specified in "NFPA 2112 Standard On Flame-Resistant Clothing For Protection Of Industrial Personnel Against Short-Duration Thermal Exposures From Fire, 2018 Edition" and "ASTM-F1959 Standard Test Method for Determining the Arc Rating of Materials for Clothing" were adopted to test the flame-retardant blended fabric prepared in the present example, and the test showed that, as shown in FIG. 1, the resulting flame-retardant blended fabric reached the NFPA 2112 standard and had an ATPV of 9.9 cal/cm$^2$. The resulting fabric was burnt, and after burning, it was discovered that, as shown in FIG. 2, a dense protective layer was formed on the surface of the resulting flame-retardant fabric after burning, and the carbon layer formed after burning protected the inner fabric against further burning, indicating that the carbonizing property was good; and as shown in FIG. 3, the thermal stability of the resulting flame-retardant fabric was excellent.

The resulting flame-retardant polymer fiber is applicable in the production of textiles, such as textile clothing, decorative articles and military fabrics for national defense, and other fiber products.

Example 2

Cyclodextrin, boric acid and guanidine sulfamate were weighed according to a mass ratio of 75:20:5 for later use.

2% of colorless and transparent acetic acid solution in parts by volume was prepared for later use.

Firstly, a base fabric including 48 wt % of polyacrylonitrile fibers, 40 wt % of cellulose fibers, 6 wt % of polyacrylate fibers and 6 wt % of polyamide fibers was soaked in 10% of aqueous ethanol solution in parts by volume, and was heated under the condition of a water bath at 60° C. for 4 hours, and the base fabric was then taken out, washed with deionized water multiple times, and dried in a drier at 60° C.

Secondly, after the dried base fabric was soaked in a grafting solution for 2 hours, the fabric was taken out to be irradiated by ultraviolet light for 10 minutes, then washed twice with acetone and deionized water respectively, and dried in the drier at 60° C. The grafting solution was glycidyl methacrylate dissolved in methanol, the concentration of which was 5% to 10% (V/V) and the grafting rate of which was 45%.

Then, cyclodextrin, boric acid and guanidine sulfamate, the total mass of which was 8 wt %, were added into the acetic acid solution under the condition of stirring at a stirring rate of 30 r/min to give a dispersed flame retardant solution, and the solution was heated to 40° C. The washed fabric was immersed into the dispersed flame retardant solution according to a bath ratio of 10:1, and was shaken in a water bath shaker with the temperature set and kept at 80° C. for 6 hours to ensure the sufficient reaction between the flame retardant and the blended fabric, and the fabric was then washed with deionized water three times and dried.

Then, a closed container filled with deionized water was heated to a temperature of 85° C., which was kept, one part by mass of aluminium isopropoxide was dissolved into two parts by mass of isopropyl alcohol to prepare an isopropyl alcohol solution, and the isopropyl alcohol solution was slowly added into deionized water at 85° C. under the condition of stirring, with the added amount being 3% (V/V) by volume and the duration of addition being 15 minutes, so that a white precipitate was formed ultimately; while the high temperature continued to be kept, the closed container was opened, so that alcohol was volatilized, hydrochloric acid accounting for 20% of aluminium isopropoxide in parts by mass was added, so that the precipitate was re-separated, and after 2 hours of aging, transparent sol gel was obtained; the flame-retardant fabric was dipped and rolled twice in the prepared transparent metal alkoxide sol gel, pre-baked, and then baked, with the padding pressure being 1 kg/cm$^3$, the pre-baking temperature being 100° C., the duration of pre-baking being 6 minutes, the baking temperature being 140° C. and the duration of baking being 3 minutes, so that the final product was obtained ultimately.

A test and analysis showed that the resulting flame-retardant fabric reached the NFPA 2112 standard and had an ATPV of 8.7 cal/cm$^2$.

Example 3

Cyclodextrin, boric acid and guanidine sulfamate were weighed according to a mass ratio of 75:20:5 for later use.

2% of colorless and transparent acetic acid solution in parts by volume was prepared for later use.

Firstly, a base fabric including 46 wt % of polyacrylonitrile fibers, 41 wt % of cellulose fibers, 7 wt % of polyacrylate fibers and 6 wt % of polyamide fibers was soaked in 10% of aqueous ethanol solution in parts by volume, and was heated under the condition of a water bath at 60° C. for 4 hours, and the base fabric was then taken out, washed with deionized water multiple times, and dried in a drier at 60° C.

Secondly, after the dried base fabric was soaked in a grafting solution for 2 hours, the fabric was taken out to be irradiated by ultraviolet light for 15 minutes, then washed twice with acetone and deionized water respectively, and dried in the drier at 60° C. The grafting solution was glycidyl methacrylate dissolved in methanol, the concentration of which was 5% to 10% (V/V) and the grafting rate of which was 45%.

Then, cyclodextrin, boric acid and guanidine sulfamate, the total mass of which was 8%, were added into the acetic acid solution under the condition of stirring at a stirring rate of 30 r/min to give a dispersed flame retardant solution, and the solution was heated to 40° C. The washed fabric was immersed into the dispersed flame retardant solution according to a bath ratio of 10:1, and was shaken in a water bath shaker with the temperature set and kept at 80° C. for 6 hours to ensure the sufficient reaction between the flame retardant and the blended fabric, and the fabric was then washed with deionized water three times and dried.

Then, a closed container filled with deionized water was heated to a temperature of 85° C., which was kept, one part by mass of aluminium isopropoxide was dissolved into two parts by mass of isopropyl alcohol to prepare an isopropyl alcohol solution, and the isopropyl alcohol solution was slowly added into deionized water at 85° C. under the condition of stirring, with the added amount being 3% (V/V) by volume and the duration of addition being 15 minutes, so that a white precipitate was formed ultimately; while the high temperature continued to be kept, the closed container was opened, so that alcohol was volatilized, hydrochloric acid accounting for 20% of aluminium isopropoxide in parts by mass was added, so that the precipitate was re-separated, and after 5 hours of aging, transparent sol gel was obtained; the flame-retardant fabric was dipped and rolled twice in the prepared transparent aluminium isopropoxide sol gel, pre-baked, and then baked, with the padding pressure being 1 kg/cm$^3$, the pre-baking temperature being 100° C., the duration of pre-baking being 6 minutes, the baking temperature being 140° C. and the duration of baking being 3 minutes, so that the final product was obtained ultimately.

A test and analysis showed that the resulting flame-retardant fabric reached the NFPA 2112 standard and had an ATPV of 9.4 cal/cm$^2$.

Example 4

Sodium alginate, boric acid and guanidine sulfamate were weighed according to a mass ratio of 78:17:5 for later use.

A colorless and transparent acetic acid solution with a concentration of 2% (V/V) was prepared for later use.

Firstly, a base fabric including 46 wt % of polyacrylonitrile fibers, 41 wt % of cellulose fibers, 7 wt % of polyacrylate fibers and 6 wt % of polyamide fibers was soaked in 10% of aqueous ethanol solution in parts by volume, and was heated under the condition of a water bath at 60° C. for 4 hours, and the fabric was then taken out, washed with deionized water multiple times, and dried in a drier at 60° C. After the dried base fabric was soaked in a grafting solution for 2 hours, the fabric was taken out to be irradiated by ultraviolet light for 15 minutes, then washed twice with acetone and deionized water respectively, and dried in the drier at 60° C. The grafting solution was glycidyl methacrylate dissolved in methanol, the concentration of which was 5% to 10% and the grafting rate of which was 59%.

Cyclodextrin, boric acid and guanidine sulfamate, the total mass of which was 8 wt %, were added into the acetic acid solution under the condition of stirring at a stirring rate of 30 r/min to give a dispersed flame retardant solution, and the solution was heated to 40° C. The washed fabric was immersed into the dispersed flame retardant solution according to a bath ratio of 10:1, and was shaken in a water bath shaker with the temperature set and kept at 80° C. for 6 hours to ensure the sufficient reaction between the flame retardant and the blended fabric, and the fabric was then washed with deionized water three times and dried.

A closed container filled with deionized water was heated to a temperature of 85° C., which was kept, one part by mass of aluminium isopropoxide was dissolved into two parts by mass of isopropyl alcohol to prepare an isopropyl alcohol solution, and the isopropyl alcohol solution was slowly added into deionized water at 85° C. under the condition of stirring, with the added amount being 3% (V/V) by volume and the duration of addition being 15 minutes, so that a white precipitate was formed ultimately; while the high temperature continued to be kept, the closed container was opened, so that alcohol was volatilized, hydrochloric acid accounting for 20% of aluminium isopropoxide in parts by mass was added, so that the precipitate was re-separated, and after 4 hours of aging, transparent sol gel was obtained; and the flame-retardant fabric was dipped and rolled twice in the prepared transparent metal alkoxide sol gel, pre-baked, and then baked, with the padding pressure being 1 kg/cm$^3$, the pre-baking temperature being 100° C., the duration of pre-baking being 6 minutes, the baking temperature being 140° C. and the duration of baking being 3 minutes.

A test and analysis showed that the resulting flame-retardant fabric reached the NFPA 2112 standard and had an ATPV of 9.2 cal/cm$^2$, but the softness of the fabric decreased. A too high grafting rate can produce more flame retardant by reaction, but will affect the comfort of the fabric itself.

Examples 1 to 3 in comparison can all achieve the flame-retardant and arc-resistant properties of the fabric, the arc-resistant property is associated with the duration of aging, and therefore, by prolonging the duration of aging, the arc-resistant property of the fabric can be increased. It can be known from the comparison between Example 1 and Example 4 that a too high grafting rate will affect the lightweightness and softness of the fabric itself, but a too low grafting rate will affect the flame-retardant property o the fabric.

Examples 1 to 3 are only the preferred examples of the present invention, rather than a limitation to other forms of the present invention. Any person skilled in the art cannot use the aforementioned technical contents as an inspiration to alter or modify them into equivalent examples with equivalent changes. However, simple modifications, equivalent changes and modifications which are made to the aforementioned examples without departing from the technical essence of the claims of the present invention shall still fall within the protection scope of the claims of the present invention. The above have shown and described the basic principle, main features and advantages of the present invention. It should be understood by those skilled in the art that the present invention is not limited by the aforementioned examples. What has been described in the aforementioned examples and the specification only illustrates the principle of the present invention. Without departing from the spirit and scope of the present invention, there will be various changes and improvements of the present invention, all of which shall fall within the claimed scope of the present invention.

What is claimed is:

1. A multi-fiber blended fabric, comprising: 82 wt % to 87 wt % of base fabric, 5 wt % to 8 wt % of flame retardant, and 8 wt % to 10 wt % of antistatic agent, wherein the flame retardant comprises 70 wt % to 80 wt % of hydroxylated polysaccharide, 15 wt % to 25 wt % of boric acid compound and 5 wt % of guanidine sulfamate.

2. The multi-fiber blended fabric according to claim 1, wherein the base fabric comprises 45% to 48% of polyacrylonitrile fibers, 40% to 42% of cellulose fibers, 6% to 9% of polyacrylate fibers and 6% to 8% of polyamide fibers in parts by mass.

3. The multi-fiber blended fabric according to claim 1, wherein the antistatic agent is a metal alkoxide, the metal alkoxide is aluminium isopropoxide, zinc diethoxide, magnesium ethoxide, or a combination thereof.

4. The multi-fiber blended fabric according to claim 1, wherein an arc thermal performance value (ATPV) of the multi-fiber blended fabric is greater than 8 cal/cm$^2$.

5. A preparation method for a multi-fiber blended fabric, the multi-fiber blended fabric comprising: 82 wt % to 87 wt % of base fabric, 5 wt % to 8 wt % of flame retardant, and 8 wt % to 10 wt % of antistatic agent, the flame retardant comprising 70 wt % to 80 wt % of hydroxylated polysaccharide, 15 wt % to 25 wt % of boric acid compound and 5 wt % of guanidine sulfamate, the method comprising:

(Step 1) washing the base fabric, soaking the base fabric in 10% of aqueous ethanol solution in parts by volume, which is heated under a water bath condition at 60° C. for 4 hours, washing the base fabric with deionized water, and drying the base fabric in a drier at 60° C.;

(Step 2) after soaking the base fabric obtained in Step 1 in a grafting solution for 1 to 2 hours, taking out the base fabric and irradiating the base fabric under ultraviolet light for 10 to 20 minutes, and then washing with acetone and deionized water and drying in the drier at 60° C. to obtain a first fabric;

(Step 3) soaking the first fabric obtained in Step 2 in a flame retardant solution, a mass ratio of the flame retardant solution to the first fabric being 10:1, shaking the flame retardant solution soaked with the first fabric in a water bath shaker at a set temperature of 80° C. for 4 to 6 hours, and then washing with deionized water and drying to obtain a second fabric;

(Step 4) dipping and rolling the second fabric obtained in Step 3 twice in a metal alkoxide sol with a padding pressure of 1 kg/cm3, performing a pre-baking process, and then baking to give a product of the multi-fiber blended fabric, a pre-baking temperature being 100° C. and a duration of the pre-baking process being 3 to 6 minutes.

6. The preparation method for the multi-fiber blended fabric according to claim 5, wherein the grafting solution in Step 2 is 5% to 10% of solution of glycidyl methacrylate in methanol in parts by volume; and a grafting rate is controlled below 45%, wherein the grafting rate is calculated according to the following formula $$GP = \frac{W_1 - W_0}{W_0} \times 100\%,$$

wherein $W_0$ denotes fabric mass before grafting, and $W_1$ denotes fabric mass after grafting.

7. The preparation method for the multi-fiber blended fabric according to claim 5, wherein the flame retardant solution in Step 3 is prepared by dispersing and dissolving flame retardant into 2% of acetic acid solution, with the flame retardant being 5% to 8% in parts by mass.

8. The preparation method for the multi-fiber blended fabric according to claim 5, wherein the metal alkoxide sol in Step 4 is prepared by: adding metal alkoxide into a closed container filled with deionized water at 85° C. to form a white precipitate; while keeping a temperature at 85° C., opening the closed container is opened to volatilize alcohol, adding hydrochloric acid accounting for 20% of the mass of the metal alkoxide, so that the precipitate is re-separated, and after 3 to 5 hours of aging, obtaining the metal alkoxide sol.

9. The preparation method for the multi-fiber blended fabric according to claim 5, further comprising Step 5: the product prepared in Step 4 is softened with air flow generated by a centrifugal fan, a direction of the air flow being changed alternately to act on the multi-fiber blended fabric.

* * * * *